US006362567B1

(12) United States Patent
Niimi

(10) Patent No.: US 6,362,567 B1
(45) Date of Patent: Mar. 26, 2002

(54) HIGH PRESSURE DISCHARGE LAMP HAVING THERMAL LAYERS MANUFACTURING THE SAME

(75) Inventor: Norikazu Niimi, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 0 days.

(21) Appl. No.: 09/191,611

(22) Filed: Nov. 13, 1998

(30) Foreign Application Priority Data

Nov. 14, 1997 (JP) ..... 9-313371

(51) Int. Cl.[7] ..... H01J 17/18
(52) U.S. Cl. ..... 313/623; 313/624; 313/626
(58) Field of Search ..... 313/623, 624, 313/625, 626, 25, 636, 634, 332

(56) References Cited

U.S. PATENT DOCUMENTS

| | | | | |
|---|---|---|---|---|
| 4,155,758 A | | 5/1979 | Evans et al. | |
| 5,552,670 A | * | 9/1996 | Heider et al. | 313/625 |
| 5,742,123 A | * | 4/1998 | Nagayama | 313/623 |
| 6,020,685 A | * | 2/2000 | Wei et al. | 313/625 |
| 6,066,918 A | * | 5/2000 | Suzuki et al. | 313/623 |

FOREIGN PATENT DOCUMENTS

| | | |
|---|---|---|
| EP | 0 650 184 | 4/1995 |
| EP | 0 751 549 | 1/1997 |
| EP | 0 887 837 | 12/1998 |

* cited by examiner

*Primary Examiner*—Nimeshkumar D. Patel
*Assistant Examiner*—Karabi Guharay
(74) *Attorney, Agent, or Firm*—Burr & Brown

(57) ABSTRACT

A high pressure discharge lamp comprises a ceramic tube having axial ends and forming a closed inner space which is filled with an ionizable light-emitting material and a starting gas. Non-conductive members are inserted into the respective ends of the ceramic tube. A conductive member has one end which protrudes into the inner space of the ceramic tube. The non-conductive member and the conductive member are tightly jointed with each other by a jointing means which includes at least two thermal buffer layers successively stacked between the non-conductive member and the conductive member in the axial direction of the ceramic tube. The non-conductive member, thermal buffer layers and conductive member have respective coefficients of thermal expansion which change gradually from the coefficient of thermal expansion of the non-conductive member to that of the conductive member.

6 Claims, 5 Drawing Sheets

HIGH PRESSURE DISCHARGE LAMP HAVING THERMAL LAYERS MANUFACTURING THE SAME

FIELD OF THE INVENTION

The present invention relates to a high pressure discharge lamp comprising a ceramic tube having a non-conductive member and a conductive member which are inserted into each end thereof, as well as a method of manufacturing such a high pressure discharge lamp.

BACKGROUND ART

Conventionally, such a high pressure discharge lamp has nonconductive members and conductive members tightly jointed on the nonconductive members, respectively, at both ends of a ceramic tube. When the high pressure discharge lamp is heated, for example during the operation of the lamp, a thermal stress and thus a strain by a thermal expansion occurs in a junction between the non-conductive member and the conductive member due to significant difference between the coefficient of thermal expansion of the non-conductive member and that of the conductive member. Owing to such strain, there may be formed a gap in the junction, an ionizable light-emitting material and a starting gas in a discharge space of the ceramic tube may leak from the gap to the outside of the ceramic tube.

To eliminate such a drawback, JP-A-5-290810 discloses a high pressure discharge lamp including a conductive member in the form of a support shaft and, a non-conductive member in which the support shaft is inserted. The non-conductive member is made of a plurality of layers formed of a mixture of alumina paste and tungsten paste, and arranged to cover one above the other over the surface of the support shaft in the radial direction of the ceramic discharge tube. In this case, as the layer comes closer to the central axis of the ceramic discharge tube, the volumetric percentage of the tungsten in the layer becomes higher and so does the coefficient of thermal expansion of the layer, in order to minimize the strain arising from the thermal expansion.

However, such an arrangement of the high pressure discharge lamp serves only to reduce the strain of the thermal expansion in the axial direction of the ceramic discharge tube. Strain due to thermal expansion is three dimensional and, hence, occurs also in the radial direction of the discharge tube. Therefore, when the high pressure discharge lamp is heated, an internal stress occurs at the ends of the ceramic discharge lamp. Because such an internal stress occurs repeatedly, a fatigue occurs in the ceramic discharge tube and causes cracks and chips to the ceramic discharge tube.

DISCLOSURE OF THE INVENTION

It is an object of the present invention to provide a high pressure discharge lamp capable of mitigating a thermal stress at an axial direction and a radial direction of a ceramic discharge tube efficiently, as well as a method of the manufacturing the same.

According to the present invention of the high pressure discharge lamp, there is provided a high pressure discharge lamp comprising:

- a ceramic tube having axial ends and forming a closed inner space which is filled with an ionizable light-emitting material and a starting gas;
- non-conductive members inserted into the respective ends of the ceramic tube;

- a conductive member having one end which protrudes into the inner space of the ceramic tube; and
- jointing means for tightly jointing the non-conductive member and the conductive member with each other, said jointing means including at least two thermal buffer layers successively stacked between the non-conductive member and the conductive member in the axial direction of the ceramic tube;
- said non-conductive member, said thermal buffer layers and said conductive member having respective coefficients of thermal expansion which change gradually from the coefficient of thermal expansion of the non-conductive member to that of the conductive member.

With the above-mentioned high pressure discharge lamp according to the invention, for tightly jointing the non-conductive member and the conductive member with each other, at least two thermal buffer layers are successively stacked between the non-conductive member and the conductive member in the axial direction of the ceramic tube. The non-conductive member, thermal buffer layers and conductive member having respective coefficients of thermal expansion which change gradually from the coefficient of thermal expansion of the non-conductive member to that of the conductive member.

For example, when the non-conductive members are composed of alumina ($Al_2O_3$) and the conductive member is composed of molybdenum (Mo), a coefficient of thermal expansion of $Al_2O_3$ is higher than that of Mo. That of $Al_2O_3$ is the highest among those of $Al_2O_3$, the thermal buffer layers and Mo, and that of the thermal buffer layer directly jointed on $Al_2O_3$ is the second highest among them, the coefficient of thermal expansion gets lower as the thermal buffer layers get nearer to Mo, the coefficient of the thermal buffer layer directly jointed on $Al_2O_3$ is the second lowest among those of $Al_2O_3$, the thermal buffer layers and Mo, and that of Mo is the lowest among them.

By changing the thermal buffer layers and the conductive member gradually from the coefficient of thermal expansion of the non-conductive member to that of the conductive member, the difference of the coefficients of thermal expansion between neighboring members (between the non-conductive member and one of the thermal buffer layers, between each of the thermal buffer layers, and between one of the thermal buffer layers and the conductive members) is smaller than the case where the conductive member is directly jointed on the non-conductive member, so that strain arising from the thermal expansion at the axial direction and the radial direction of the ceramic tube is reduced. Consequently, when the high pressure discharge lamp is heated, the thermal stress at the axial direction and the radial direction of the ceramic tube can be mitigated efficiently.

Preferably, the thermal buffer layer which is directly jointed on the non-conductive member is composed of a material from which forms the non-conductive member, the thermal buffer layer which is directly jointed on the conductive member is composed of a material from which forms the conductive member.

By composing the thermal buffer layer directly jointed on the non-conductive member with a material from which forms the non-conductive member and composing the thermal buffer layer directly jointed on the conductive member with a material from which forms the conductive member in such a way, roughness of surfaces of the non-conductive member and the conductive member is buried, so that a conformability effect is obtained.

More preferably, each of the thermal buffer layers is composed of a mixture of the material from which forms the non-conductive member and the material from which forms the conductive member, the volumetric percentage of the material from which forms the conductive member in the thermal buffer layer becomes higher as the thermal buffer layer comes closer to the conductive member.

By changing the volumetric percentage in such a way, the coefficients of thermal expansion can be easily inclined, so that the thermal stress can be mitigated more efficiently.

According to the method of manufacturing a high pressure discharge lamp of the present invention, there is provided a method of manufacturing a high pressure discharge lamp, comprising the steps of:

inserting non-conductive members into respective ends of a ceramic tube which forms a closed inner space filled with an ionizable light-emitting material and a starting gas;

successively stacking at least two thermal buffer layers on an outer face of the non-conductive member in the axial direction of the ceramic tube so as to be tightly jointed on the non-conductive member; and jointing a conductive member to the thermal buffer layers such that one end of the conductive member protrudes into the inner space of the ceramic tube to thereby form a structure wherein coefficients of the thermal expansion of the non-conductive member, the thermal buffer layers and the conductive member change gradually from the coefficient of thermal expansion of the non-conductive member to that of the conductive member.

With the above-mentioned method according to the present invention, first non-conductive members are inserted into respective ends of a ceramic tube which forms a closed inner space filled with an ionizable light-emitting material and a starting gas. Secondly, at least two thermal buffer layers successively stack on an outer face of the non-conductive member in the axial direction of the ceramic tube so as to tightly joint on the non-conductive member. Lastly, a conductive member is jointed to the thermal buffer layers such that one end of the conductive member protrudes into the inner space of the ceramic tube to thereby form a structure wherein coefficients of the thermal expansion of the non-conductive member, the thermal buffer layers and the conductive member change gradually from the coefficient of thermal expansion of the non-conductive member to that of the conductive member.

By manufacturing the high pressure discharge lamp in such a way, it is possible to manufacture a high pressure discharge lamp capable of mitigating a thermal stress at an axial direction and a radial direction of a ceramic discharge tube efficiently.

Preferably, the thermal buffer layer which is directly jointed on the non-conductive member is composed of a material from which forms the non-conductive member and, the thermal buffer layer which is directly jointed on the conductive member is composed of a material from which forms the conductive member.

In this case, it is possible to manufacture the high pressure discharge lamp capable of obtaining the conformability effect.

More preferably, each of the thermal buffer layers is composed of a mixture of the material from which forms the non-conductive member and the material from which forms the conductive member. In such a configuration, volumetric percentage of the material from which forms the conductive member in the thermal buffer layers becomes higher as the thermal buffer layer comes closer to the conductive member.

In this case, it is possible to manufacture the high pressure discharge lamp capable of inclining the coefficients of thermal expansion easily and thus mitigating the thermal stress at the axial direction and the radial direction of a ceramic discharge tube more efficiently.

More preferably, each of the thermal buffer layers is formed by printing a paste or a mixture of pastes.

As the thermal buffer layers are formed with one or more flexible soft pastes, the conformability to the non-conductive member and the conductive member is improved, so that the thermal buffer layers can be easily formed.

DESCRIPTION OF THE PREFERRED EMBODIMENTS

Figure 1:
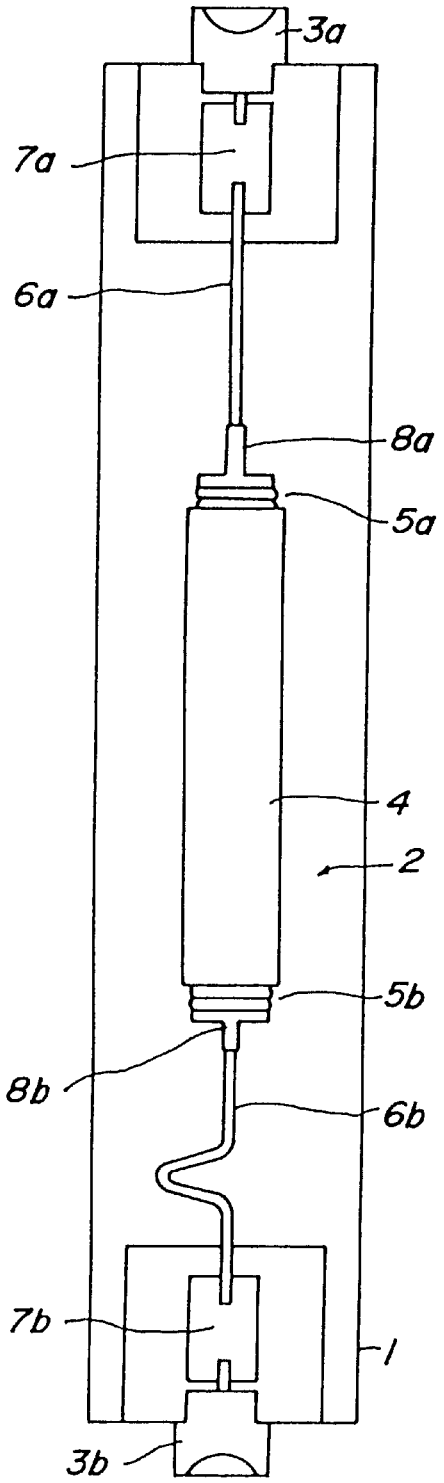
FIG. 1 is a view showing first embodiment of the high pressure discharge lamp according to the present invention.

The first embodiment of the high pressure discharge lamp according to the present invention will be explained with reference to the drawings. In the drawings, the same reference number refers to the same member.

FIG. 1 is a plane view for schematically showing one embodiment of the entire structure of the high pressure discharge lamp. A ceramic discharge tube 2 is placed in outer tube 1 made of quartz glass or hard glass, and the center axis of the outer tube 1 is accurately aligned with that of the ceramic discharge tube 2.

Both ends of the outer tube 1 are tightly sealed with respective caps 3*a*, 3*b*. The ceramic discharge tube 2 comprises a tubular vessel 4, and thermal buffer portions of a multi-layer 5*a*, 5*b* having at least two thermal buffer layers (two thermal buffer layers in FIG. 1) at both ends of the vessel 4, respectively. The ceramic discharge tube 2 is held by the outer tube 1 via two lead wires 6*a*, 6*b*. The lead wires 6*a*, 6*b* are connected to the respective caps 3*a*, 3*b* via respective foils 7*a*, 7*b*. The upper wire 6*a* is welded to a collar electrode unit-holding member 8*a*, while the lower lead wire 6*b* is welded to a collar electrode unit-holding member 8*b*. Here, a ceramic tube in the claims corresponds to the vessel 4 in the specification, the ceramic discharge tube in the specification means a combination of the vessel 4 and, an electrode unit or the like.

Figure 2:
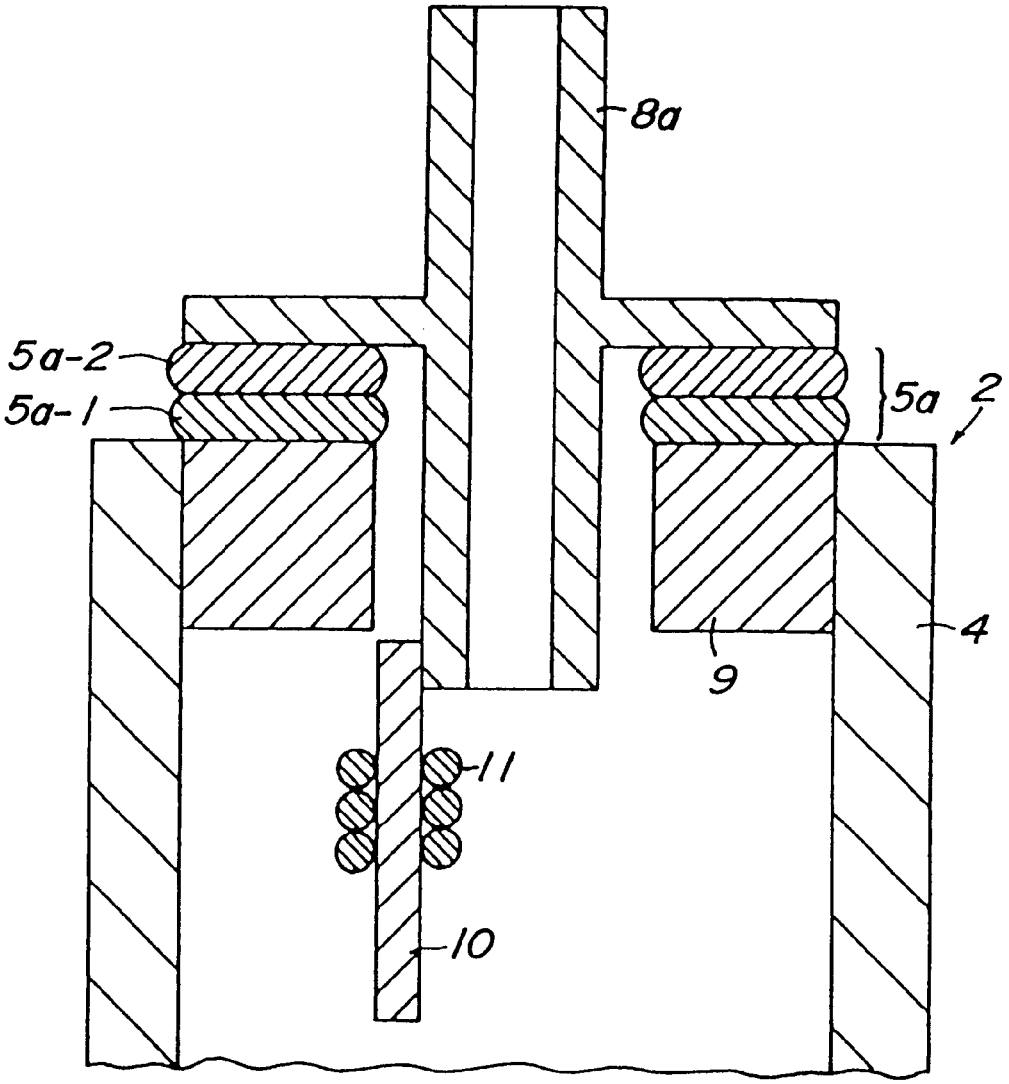
FIG. 2 is a sectional view for showing, in an enlarged scale, the surrounding area around an end portion of the first embodiment of the high pressure discharge lamp according to the present invention.

FIG. 2 is a sectional view for showing, in an enlarged scale, the surrounding area around an end portion of the second embodiment of the high pressure discharge lamp according to the present invention. In FIG. 2, the collar electrode unit-holding member 8*a* is inserted into a through-hole in a non-conductive disc 9 which forms the non-conductive member at the end of the vessel 4. The electrode unit-holding member 8*a* is tightly connected to an electrode shaft 10 by welding. A coil 11 is wound around the electrode shaft 10, thereby constituting an electrode unit as the conductive member.

A variety of metals having a high melting point or conductive ceramics can be used as a material of the electrode unit composed of the collar electrode unit-holding member 8*a*, the electrode shaft 10 and the coil 11 but it is preferable to compose the electrode unit from metals having a high melting point in the conductive point of view. As the metals having a high melting point, one or more kinds of metals selected from the group consisting of molybdenum (Mo), tungsten (W), rhenium (Re), niobium (Nb), tantalum (Ta) and their alloys are preferred.

Among them, although niobium and tantalum have coefficients of thermal expansion almost meeting those of ceramics constituting the vessel 4, particularly that of aluminate ceramics, niobium and tantalum are likely to be corroded with the ionizable light-emitting material or the like in the vessel 4. Therefore, in order to prolong the service life, it is preferable to form the electrode unit from a metal selected from the group consisting of molybdenum, tungsten, rhenium and their alloys. However, the metals having high corrosion resistance against the ionizable light-emitting material generally have small coefficients of thermal expansion. For example, the coefficient of thermal expansion of aluminate ceramics is $8\times10^{-6}K^{-1}$, that of molybdenum is $6\times10^{-6}K^{-1}$, those of tungsten and rhenium are not more than $6\times10^{-6}K^{-1}$. In the following embodiment, the electrode unit is made of Mo.

In the case where molybdenum is used as a material of the electrode unit, it is particularly preferable that at least one kind of $La_2O_3$ and $CeO_2$ is contained in molybdenum in a total amount of 0.1 to 2.0 percentage by weight.

The vessel 4 is made of alumina or cermet, and the non-conductive disc 9 is composed of $Al_2O_3$, $SiO_2+Al_2O_3$ or $MoSi_2+Al_2O_3$. In the following embodiment, the non-conductive disc 9 is made of alumina.

At both ends of the ceramic discharge tube 2, for example, a sealing method may be employed as described in JP-A-6-3188435, however, at one end of the tube or at the side of the collar electrode unit-holding member 8*b* (FIG. 1), an ionizable light-emitting material and a starting gas is tubular shaped poured into the ceramic discharge tube through the through-hole of the tubular shape collar electrode unit-holding member 8*b* (FIG. 1). After the ionizable light-emitting material and the starting gas are sealing charged into the inner space of the vessel 4, the end of the collar electrode unit-holding member 8*b* (FIG. 1) is sealed by laser welding or TIG welding. One or more kinds of material selected from the group consisting of $Y_2O_3$, $Al_2O_3$, $SiO_2$, $Dy_2O_3$ and $MoO_3$ are used as a frit seal 14.

In the embodiment, the thermal buffer portion of multi-layer 5*a* consists of a thermal buffer layer 5*a*-1 which is composed of 40 volumetric percentage of Mo and 60 volumetric percentage of $Al_2O_3$, and a thermal buffer layer 5*a*-2 which is composed of 60 volumetric percentage of Mo and 40 volumetric percentage of $Al_2O_3$. As the coefficient of thermal expansion of $Al_2O_3$ is higher than that of Mo, the coefficient of thermal expansion becomes higher in the order of the non-conductive disc 9, the thermal buffer layer 5*a*-1, the thermal buffer layer 5*a*-2 and the collar electrode unit-holding member 8*a*. In this case, each of the thermal buffer layers 5*a*-1 and 5*a*-2 has a thickness of not less than 10 $\mu$m.

By changing the coefficients of thermal expansion of the thermal buffers with an inclination from the non-conductive disc 9 to the collar electrode unit-holding member 8*a* in the axial direction of the ceramic discharge tube 2 in such a way, differences of the coefficients of thermal expansion between neighboring members (that is, between the non-conductive disc 9 and the thermal buffer layer 5*a*-1, between the thermal buffer layer 5*a*-1 and the thermal buffer layer 5*a*-2, and between the thermal buffer layer 5*a*-2 and the collar electrode unit-holding member 8*a*) becomes smaller, so that strain arising from the thermal expansion in the axial direction and the radial direction of the ceramic discharge tube 2 is reduced. Consequently, it is possible to mitigate the thermal stress in the axial direction and the radial direction of a ceramic discharge tube 2 (FIG. 1) efficiently when the high pressure discharge lamp 1 (FIG. 1) is heated.

Also, by changing the volumetric percentage of Mo and $Al_2O_3$ in the thermal buffer layers 5*a*-1 and 5*a*-2, the coefficients of thermal expansion can be easily inclined, so that it is possible to mitigate the thermal stress in the axial direction and the radial direction of the ceramic discharge tube 2 (FIG. 1) more efficiently.

Figure 3:
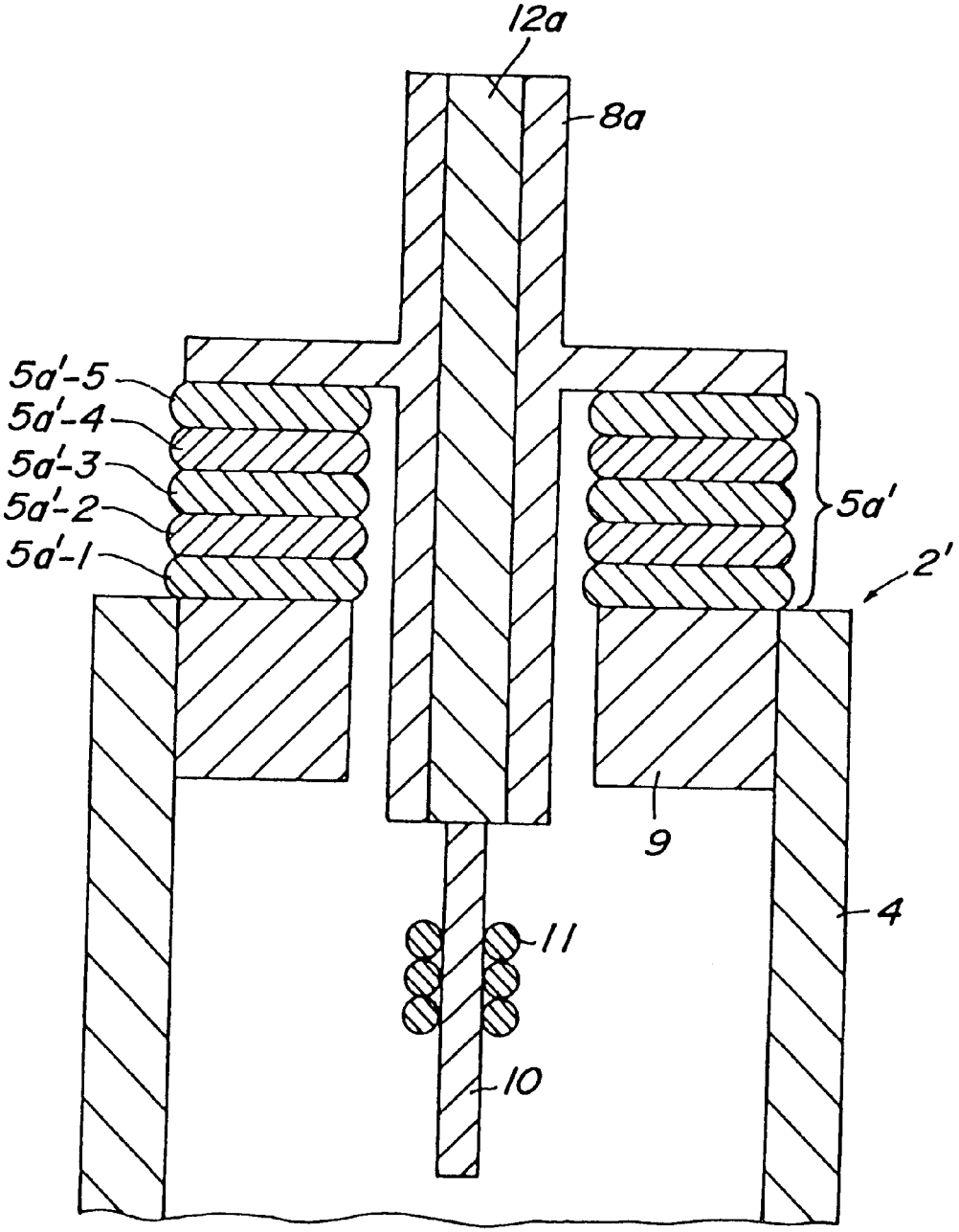
FIG. 3 is a sectional view for showing, in an enlarged scale, the surrounding area around an end portion of second embodiment of the high pressure discharge lamp according to the present invention.

FIG. 3 is a sectional view for showing, in an enlarged scale, the surrounding area around an end portion of the second embodiment of the high pressure discharge lamp according to the present invention. In FIG. 3, an electrode 12*a* which is wound around an electrode shaft 10 thereof is inserted into the through-hole of the collar electrode unit-holding member 8*a*, thereby constituting an electrode unit as the conductive member.

In the embodiment, a thermal buffer portion of multi-layer 5*a*' is constituted by a thermal buffer layer 5*a*'-1 which is made of $Al_2O_3$, a thermal buffer layer 5*a*'-2 which is made of 30 volumetric percentage of Mo and 70 volumetric percentage of $Al_2O_3$, a thermal buffer layer 5*a*'-3 which is made of 50 volumetric percentage of Mo and 50 volumetric percentage of $Al_2O_3$, a thermal buffer layer 5*a*'-4 which is made of 70 volumetric percentage of Mo and 30 volumetric percentage of $Al_2O_3$ and a thermal buffer layer 5*a*'-5 which is made of Mo. In this case, the coefficients of thermal expansion of the buffers become higher in the order of the non-conductive disc 9, the thermal buffer layer 5*a*'-1, the thermal buffer layer 5*a*'-2, the thermal buffer layer 5*a*'-3, the thermal buffer layer 5*a*'-4, the thermal buffer layer 5*a*'-5 and the collar electrode unit-holding member 8*a*.

According to the embodiment, the thermal buffer layer 5*a*'-1 is made of a material from which forms the non-conductive disc 9 and is jointed on the non-conductive disc 9. The thermal buffer layer 5*a*'-5 is made of a material from which forms the collar electrode unit-holding member 8*a* and is jointed on the collar electrode unit-holding member 8*a*. Such a construction allows for the roughness of the surfaces of the non-conductive disc 9 and the collar electrode unit-holding member 8*a* to be buried and thus a conformability effect is obtained.

Figure 4:
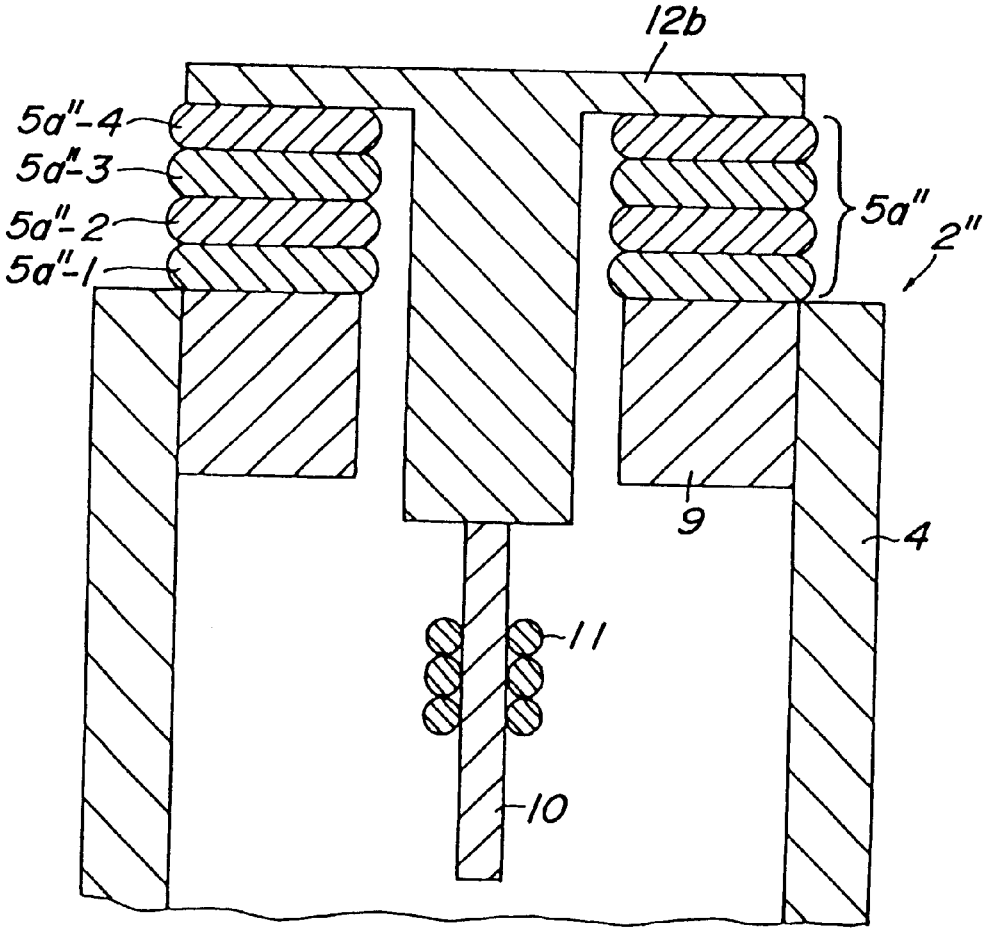
FIG. 4 is a sectional view for showing, in an enlarged scale, the surrounding area around an end portion of third embodiment of the high pressure discharge lamp according to the present invention.

FIG. 4 is a sectional view for showing, in an enlarged scale, the surrounding area around an end portion of the third embodiment of the high pressure discharge lamp according to the present invention. In FIG. 4, an electrode 12*b* which is wound around an electrode shaft 10 thereof is jointed to a thermal buffer portion of the multi-layer, thereby constituting an arrangement of an electrode as the conductive member.

In the embodiment, a thermal buffer portion of multi-layer 5*a*" is constituted by a thermal buffer layer 5*a*"-1 which is made of $Al_2O_3$, a thermal buffer layer 5*a*"-2 which is made of 30 volumetric percentage of Mo and 70 volumetric percentage of $Al_2O_3$, a thermal buffer layer 5*a*"-3 which is made of 50 volumetric percentage of Mo and 50 volumetric percentage of $Al_2O_3$, a thermal buffer layer 5*a*"-4 which is made of 70 volumetric percentage of Mo and 30 volumetric percentage of $Al_2O_3$ and a thermal buffer layer 5*a*"-5 which is made of Mo. In this case, the coefficients of thermal expansion of the buffers thereof becomes higher in the order of the non-conductive disc 9, the thermal buffer layer 5*a*"-1, the thermal buffer layer 5*a*"-2, the thermal buffer layer 5*a*"-3, the thermal buffer layer 5*a*"-4, the thermal buffer layer 5*a*"-5 and the collar electrode unit-holding member 12*b*.

Next, a method of manufacturing the high pressure discharge lamp is described for the first embodiment of the invention.

Figure 5:
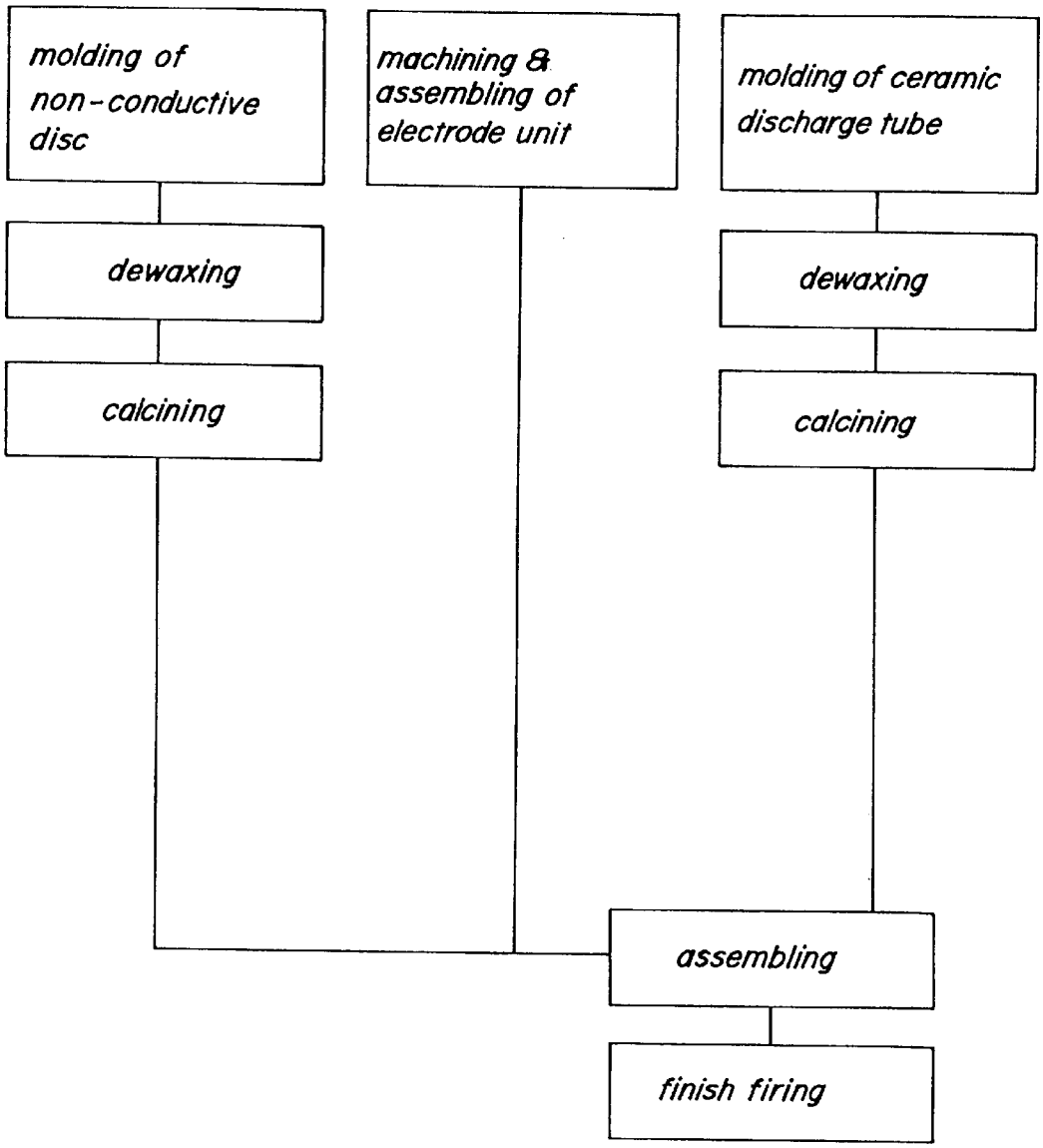
FIG. 5 is a flow chart illustrating the process for manufacturing the high pressure discharge lamp of the present invention.

FIG. 5 is a flow chart illustrating the process for manufacturing the high pressure discharge lamp of the present invention. First, alumina or cermet powder granulated by a spray dryer or the like is press molded under pressure of 2000 to 3000 kgf/cm$^2$, thereby obtaining molded bodies for the non-conductive disc 9 (FIG. 2). Preferably, the molded bodies are dewaxed under heating at a temperature of 600 to 800° C., and calcined at a temperature of 1200° C. in a hydrogen-reducing atmosphere. Some strength is given to such molded bodies and that handling of the non-conductive disc 9 (FIG. 2) may be facilitated by this calicining.

Machining and assembling of an electrode unit are effected in parallel to the molding, dewaxing and calicining of the non-conductive disc (FIG. 2). In forming the collar electrode unit-holding member 8*a* (FIGS. 1 and 2), a collar made of Mo powder is jointed to a pipe made of Mo at a temperature of 1700 to 1900° C. using powder metallurgy. Also, the vessel 4 of the ceramic discharge tube 2 (FIG. 2) is molded, and a calcined body for the ceramic discharge tube 2 (FIG. 2) is obtained by dewaxing and calicining the molded body. The calicined bodies for the non-conductive member 9 (FIG. 2) are inserted and set into the ends of the calicined body for the ceramic discharge tube, respectively. Next, the thermal buffer layers 5*a*-1 and 5*a*-2 are successively applied by printing a paste or a mixture of pastes, the electrode unit is provided on the thermal buffer layer 5*a*-2, and finish firing is effected at 1600 to 1900° C. in a reducing atmosphere having a dew point of −15 to 15° C., thereby obtaining the high pressure discharge lamp shown in FIG. 2.

According to the method of manufacturing the high pressure discharge lamp, it is possible to manufacture a high pressure discharge lamp capable of mitigating a thermal stress at the axial direction and the radial direction of the ceramic discharge tube efficiently. Also, as the thermal buffer layers are formed with one or more flexible soft paste, the conformability to the non-conductive member and the conductive member is improved, so that the thermal buffer layers can be easily formed.

While the present invention has been described above with reference to certain preferred embodiments, it should be noted that they were presented by way of examples only and various changes and/or modifications may be made without departing from the scope of the invention. For example, the ceramic discharge tube may take a cylindrical form, a barrel form or the like. The vessel of the ceramic discharge tube may made of other fire resistance materials.

The collar electrode unit-holding member may be formed by hot (warm) working, cold working, shrinkage fitting, or casting. Also, the thermal buffer portion of the multi-layer may be formed by the multi-layer press molding process or by the doctor blade process.

When the multi-layer press molding process is used, a binder is added to the ceramic component (e.g. alumina component). The binder is preferably a binder which is likely to be thermally decomposed and easily pressed. As the binder, polyvinyl alcohol (PVA) and acrylic binder are preferred. The binder and a given amount of a solvent are added to the above ceramic component, and the mixture is granulated by a spray dryer or the like, thereby producing granules. The thermal buffer portion of the multi-layer is obtained by process molding the granules under pressure of 2 to 3 tons/cm$^2$.

On the other hand, when the doctor blade process is used, a binder such as acrylic binder, ethyl cellulose or the like, and a solvent such as ethylcarbitol acetate, butylcarbitate acetate or the like, are added to the ceramic component, thereby obtaining a slurry, and a sheet molding is subsequently carried out.

Further, the number of the thermal buffer layers may be not less than 2, and the component of the thermal buffer layers (in the above embodiment, volumetric percentage of molybdenum and alumina) may take any component as long as the volumetric percentage of molybdenum in the thermal buffer layer changes gradually .

What is claimed is:

1. A high pressure discharge lamp comprising:

a ceramic tube having axial ends and forming a closed inner space which is filled with an ionizable light-emitting material and a starting gas;

non-conductive members inserted into the respective ends of the ceramic tube and having axial end surfaces substantially aligned with respective axial ends of said ceramic a conductive member including at least one radially extending portion and having one end which protrudes into the inner space of the ceramic tube; and jointing means for tightly jointing the non-conductive member and the conductive member with each other, said jointing means including at least two thermal buffer layers successively stacked between the non-conductive member and the radially extending portion of the conductive member in the axial direction of the ceramic tube;

said non-conductive member, said thermal buffer layers and said conductive member having respective coefficients of thermal expansion which change gradually from the coefficient of thermal expansion of the non-conductive member to that of the conductive member.

2. The discharge lamp according to claim 1, wherein the number of the thermal buffer layers is not less than 4, the thermal buffer layer which is directly jointed on the non-conductive member is composed of a material which forms the non-conductive member, the thermal buffer layer which is directly jointed on the conductive member is composed of a material which forms the conductive member.

3. The discharge lamp according to claim 2, wherein each of the thermal buffer layers is composed of a mixture of the material which forms the non-conductive member and the material which forms the conductive member, and the volumetric percentage of the material which forms the conductive material in the thermal buffer layers increases with decreasing proximity to the conductive member.

4. The discharge lamp according to claim 1, wherein each of the thermal buffer layers is composed of a mixture of the material which forms the non-conductive member and the material which forms the conductive member, and the volumetric percentage of the material which forms the conductive material in the thermal buffer layers increases with decreasing proximity to the conductive member.

5. The discharge lamp according to claim 1, wherein an outer radial surface of said radially extending portion is substantially axially aligned with an outer radial surface of said non-conductive member.

6. The discharge lamp according to claim 1, wherein said radially extending portion is positioned outside of the axial ends of said ceramic tube.

* * * * *

UNITED STATES PATENT AND TRADEMARK OFFICE

CERTIFICATE OF CORRECTION

PATENT NO. : 6,362,567 B1
DATED : March 26, 2002
INVENTOR(S) : Norikazu Niimi

It is certified that error appears in the above-identified patent and that said Letters Patent is hereby corrected as shown below:

Title page,
Item [54], please replace, "HIGH PRESSURE DISCHARGE LAMP HAVING THERMAL LAYERS MANUFACTURING THE SAME" with
-- HIGH PRESSURE DISCHARGE LAMP HAVING THERMAL LAYERS --

Signed and Sealed this

Twenty-seventh Day of August, 2002

*Attest:*

*Attesting Officer*

JAMES E. ROGAN
*Director of the United States Patent and Trademark Office*